United States Patent [19]

Stewart

[11] 3,965,822

[45] June 29, 1976

[54] SHOULDER TAMPING LIFTING JACK

[75] Inventor: John Kenneth Stewart, Columbia, S.C.

[73] Assignee: Canron, Inc., New York, N.Y.

[22] Filed: Nov. 11, 1974

[21] Appl. No.: 522,749

[52] U.S. Cl. ..... 104/7 B; 104/12

[51] Int. Cl.[2] ..... E01B 27/17

[58] Field of Search ..... 104/7 R, 7 B, 8, 10, 104/12; 60/537, 539

[56] References Cited

UNITED STATES PATENTS

| | | | |
|---|---|---|---|
| 1,196,040 | 8/1916 | Smith | 60/537 X |
| 3,338,174 | 8/1967 | Oville | 104/8 |
| 3,486,461 | 12/1969 | Plasser et al. | 104/7 R X |
| 3,608,496 | 9/1971 | Schenkir et al. | 104/12 |
| 3,735,708 | 5/1973 | Plasser et al. | 104/8 X |
| 3,849,986 | 11/1974 | Vural | 60/537 |

*Primary Examiner*—Frank E. Werner
*Assistant Examiner*—Randolph A. Reese

[57] ABSTRACT

A method and apparatus for aligning track and compacting ballast therebetween. A pair of shoes contoured to fit the shoulder of the ballast is placed in contact with the shoulder whereby each shoe is located on the outside of a respective one of the rails and extends in a longitudinal direction along the shoulder. A vibration device is used to fluidize portions of the ballast beneath each of the shoes and between each shoe and the ends of the adjacent ties. A lifting jack is articulately connected to each shoe and the two jacks apply a lifting force to the rails substantially equal to the weight of the track by means of laterally and vertically adjustable clamps adapted to grasp each of the rails. A lateral force is then applied to the rails by means of the clamps to displace the track in a substantially horizontal position through said fluidized ballast. The shoes have an appropriate surface area whereby the applied forces per unit area on the shoes are of a magnitude to substantially prevent vertical and lateral movement of the shoes in the ballast during the vibration and aligning operation.

7 Claims, 2 Drawing Figures

SHOULDER TAMPING LIFTING JACK

BACKGROUND OF THE INVENTION

This invention relates to a track aligner for use in railroad maintenance and particulary to the use of contoured shoes on such an aligner which are capable of vibrating the ballast upon which they are positioned outside the track rails during an aligning operation.

It is presently known to use auxiliary shoulder compacters during a railroad track aligning or tamping operation in order to prevent the vibrated ballast beneath the track from flowing to the outside portion of the rails which would thereby reduce the support given to the ties by the ballast. During a tamping operation between the ties, ballast tends to flow to the outside portion of the track and the auxiliary shoulder tamper, by counteracting this outward pressure, provides restraint to the ballast flow. The known auxiliary tamper may have its geometry varied so as to have the capability of being positioned in various places on the shoulder and it may also have the ability, in some machines, to provide lateral force to the tie thereby moving it in a horizontal direction for track alignment purposes.

Although the auxiliary tamper used in prior machines for tamping purposes may provide vibration to the ballast, this vibration does little to aid an aligning operation. Similarly, the auxiliary tamper used on aligning operations, which may be given a position adjacent a tie to exert lateral force thereon, will be required to provide a large force since the ballast opposing the tie end during its lateral movement is not in a fluidized state.

SUMMARY OF THE INVENTION

Accordingly, the invention provides a method of aligning track and compacting the ballast of a railroad comprising the steps of: placing a pair of shoes contoured to fit the shoulder of said ballast into contact with said shoulder, each of said contoured shoes being located on the outside of a respective one of the rails of the track and extending in a longitudinal direction along said ballast shoulder, utilizing vibration means to fluidize portions of said ballast beneath each of said shoes and between each of said shoes and the ends of the adjacent ties; applying a lifting force to said track substantially equal to the weight of said track; and applying a lateral force to said rails to displace said track in a substantially horizontal position through said fluidized ballast, said contoured shoes having an appropriate surface area whereby the applied force per unit area on said shoes is of a magnitude to substantially prevent vertical and lateral movement of said shoes in said ballast during the vibration and aligning operation.

A further step in the method may be provided which consists of inserting tamping tools into the ballast between said contoured shoes and performing a tamping operation. Conveniently, the substantially horizontal track displacement is finished before the completion of the tamping operation to consolidate the track in conventional fashion.

There is also provided a machine for aligning railroad track into a substantially correct position comprising: laterally and vertically adjustable clamping means to grasp each of the rails of the railroad for purposes of track displacement; a pair of contoured shoes, each one of said respective shoes being adapted to embrace the shoulder portion of the railroad ballast located on the outside of each respective rail; a lifting jack articulately connected to each of said shoes adapted to provide a substantially vertical force to said clamping means; and means to provide vibration to said contoured shoes during said alignment operation, each of said respective contoured shoes having an appropriate surface area whereby in use the force per unit area on said shoe is of a magnitude to substantially prevent said contoured shoe from vertical and lateral movement in said ballast during said alignment operation.

A further embodiment of the apparatus may be provided wherein one of the vibration means is mounted on each contoured shoe. Alternatively, it may be desired to utilize a pair of mechanical pulsers and operate the lifting jacks hydraulically, each of the pulsers communicating with the fluid in one of the lifting jacks.

There is further provided a vibration device for use in railroad alignment and compacting operations comprising a compactor adapted to be positioned in contact with ballast of a railroad, a hydraulic cylinder connected to said compactor, and a mechanical pulser unit communicating with the fluid in said hydraulic cylinder whereby vibration is provided to said compactor.

A further embodiment of the vibration device may be provided wherein the mechanical pulser includes a piston reciprocally mounted in the hydraulic cylinder and adapted to communicate with the fluid therein.

BRIEF DESCRIPTION OF DRAWINGS

The invention will now be described, by way of example only, with reference to the accompanying drawings in which.

DETAILED DESCRIPTION OF PREFERRED EMBODIMENT

Figure 2:
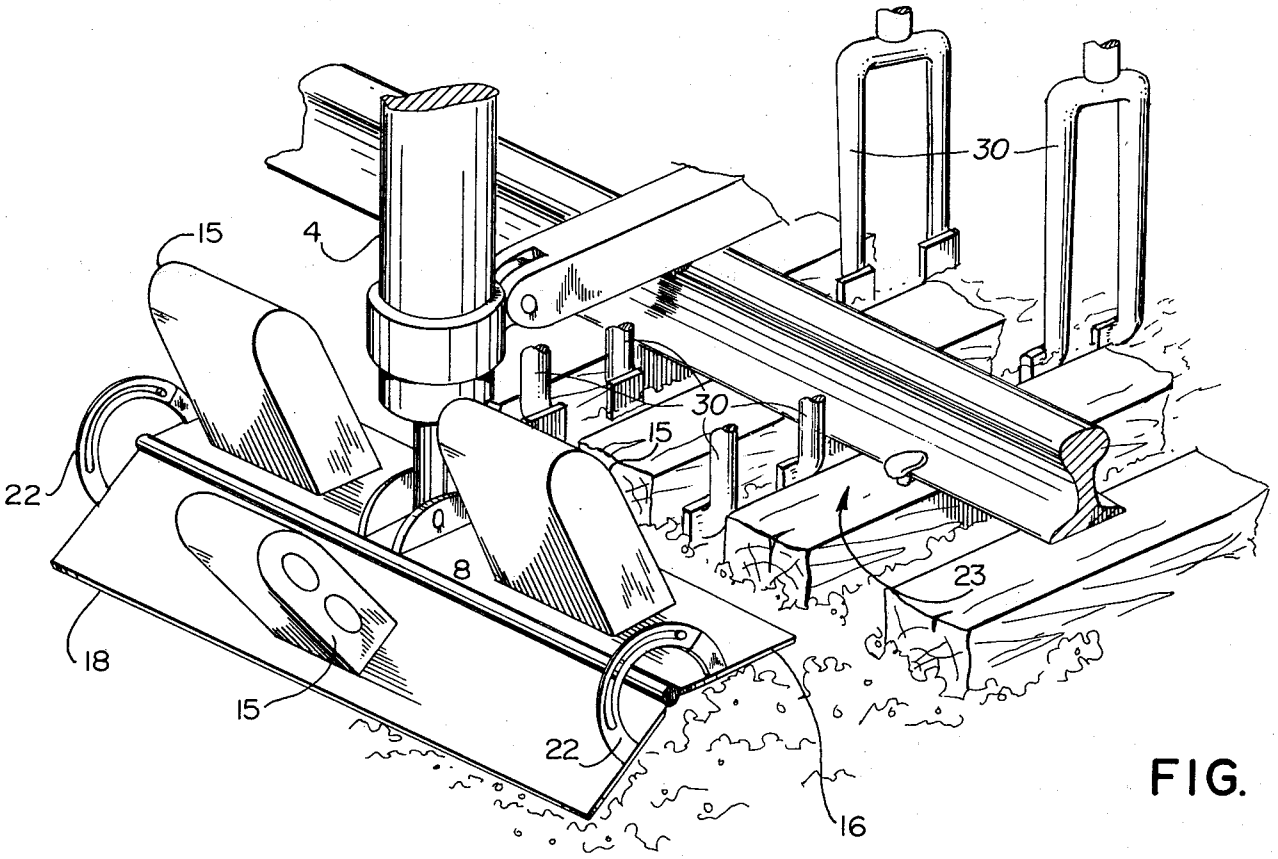
FIG. 2 is a perspective view of a ballfast engaging shoe.

Track maintenance machines comprising devices for lifting, aligning and tamping railroad track are well known in the art, for example see U.S. Pat. Nos. 3,144,834 issued Aug. 18, 1964 and 3,230,895 issued Jan. 24, 1966. Consequently, it is not considered necessary to provide illustrations of the entire machine although representative tamping tools of conventional configuration are shown at 30 in FIG. 2. Accordingly, the lifting and aligning portion only of a track maintenance machine is shown generally at 1 and comprises a frame 7 having track engaging clamps 6 (only one of which is shown) mounted thereon. Slideably positioned for lateral movement relative to the frame 7 are lifting jacks 4, 5 articulately connected to contoured shoes 2, 3. The clamps 6 and telescopic lifting jacks 4, 5 can be of a type well known in the art (see for example aforementioned U.S. Pat. No. 3,230,895). Hydraulic jack 10 is pivotally connected to lifting jacks 4, 5 and provides the horizontal force necessary for frame and track displacement.

The contoured shoes 2, 3 are designed to fit the edge of the shoulder portions of the ballast 12 through use of upper plates 16, 17 articulately connected at 13, 14 to angularly related downwardly and sidewardly extending side plates 18, 19 which are angularly positioned by circular clamps 22. The shoes are necessarily of a size sufficient to substantially resist lateral and vertical motion during an alignment operation when the vibrators 15 are actuated because it is necessary for the track to move a greater distance in one direction than the contoured shoes in the opposite direction. Consequently, this condition is met when the length of the shoe extends on the shoulder a distance of about four tie spacings or more. Because of the length of the shoes 2, 3, it is preferred to articulately connect the lifting jack 4, 5 at a distance intermediate the shoe ends, this intermediate position being on the shoulder and laterally opposed to the position of the rail engaging clamp. The vibrators 15 are operated through the rotation of unbalanced eccentrics or may be of any other suitable type, for example, a linear hydraulic motor.

The track engaging clamp 6 is mounted on the frame 7 of the aligning machine in a manner known in the art. The frame 7 is capable of vertical movement in response to movement of the lifting jacks 4, 5 and may be moved laterally relative to the lifting jacks when in the lifted position by use of the hydraulic cylinder 10 providing the substantially horizontal force on the frame. The lateral movement of the frame 7 will be of a magnitude suitable to move the track to its aligned position.

Figure 1:
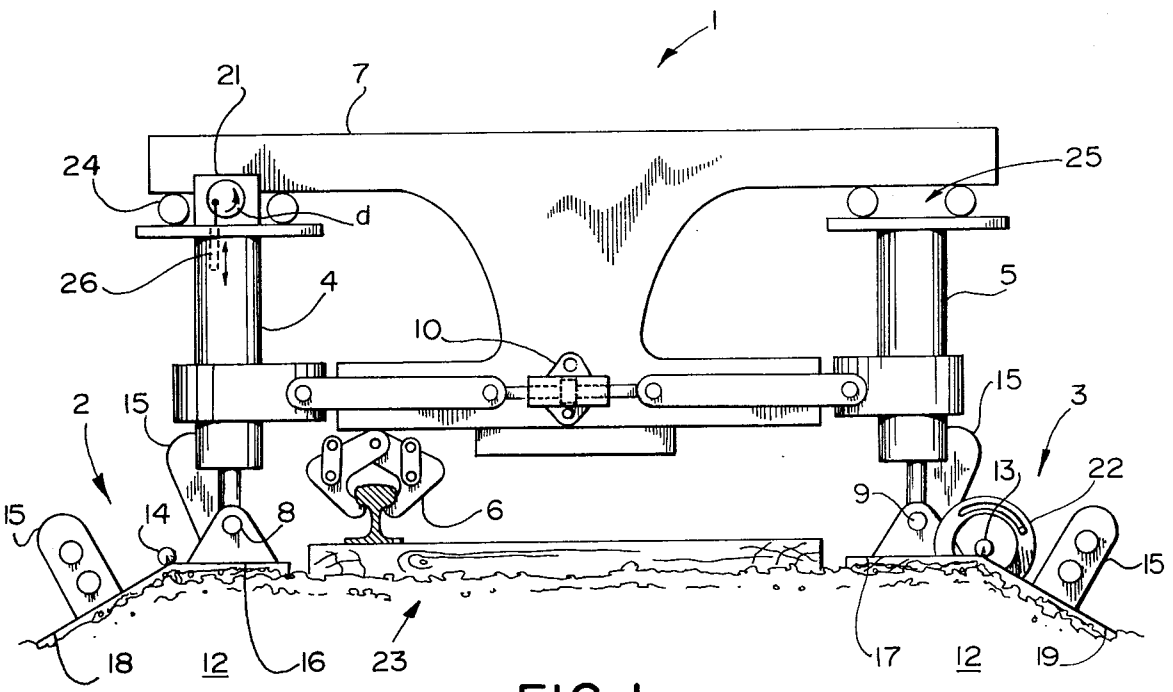
FIG. 1 is a front detail view of a track maintenance machine.

In operation, the aligning machine 1 is moved to a position where the track is desired to be aligned and the contoured shoes 2, 3 are then lowered into firm contact with the ballast 12 of the railroad. Track engaging clamp 6 is moved to grasp the rail as shown in FIG. 1. Vibrators 15 provide fluidization to the ballast 12 adjacent the ends of the ties and under the contoured shoes 2, 3 and lifting jacks 4, 5 may be actuated to raise the frame 1 which provides vertical displacement to the rails and the ties if required. Hydraulic cylinder 10 is then moved either to the left or right thereby giving the frame 7 and track 23 a lateral displacement relative to the lifting jacks. Since fluidization is provided outside both ends of the tie, the tie is always directed into fluidized ballast thereby reducing the aligning forces required to be exerted by the cylinder 10. Furthermore, because of the substantial fluidization area of ballast surrounding the tie, accurate alignment of the track is greatly facilitated.

Rather than mount the vibrators 15 on the contoured shoes 2, 3 an alternative technique may utilize mechanical pulser units 21 (only one of which is shown) communicating with the lifting jacks 4, 5 in which case the jacks are hydraulically operated. Utilizing this technique, the lifting jacks may be isolated from the frame by suitable dampening means located at 24, 25 and the vibration is thereby passed directly to the contoured shoes 2, 3 and into the ballast 12. The mechanical pulser unit comprises a small piston 26 which reciprocates in the cylinder 4 under the action of an eccentric which may be electrically driven.

While a preferred embodiment of the invention has been described it is apparent that the invention is capable of modification from the form shown so that the scope thereof should be limited only by the scope of the claims appended hereto.

What I claim as my invention is:

1. A method of aligning track of a railroad comprising the steps of: placing a pair of shoes contoured to fit the shoulder of said ballast into contact with said shoulder, each of said contoured shoes being located on the outside of a respective one of the rails of said track and extending in a longitudinal direction along said ballast shoulder; utilizing vibration means to transmit vibration to said shoes to fluidize portions of said ballast beneath each of said shoes and between each of said shoes and the ends of the adjacent ties; applying a lifting force to said track by actuating lifting jacks articulately connected to respective shoes, said lifting force being substantially equal to the weight of said track while said shoes are vibrated; and applying a lateral force to said rails to displace said track in a substantially horizontal position through said fluidized ballast, said contoured shoes having an appropriate surface area whereby the applied forces per unit area on said shoes are of a magnitude to substantially prevent vertical and lateral movement of said shoes in said ballast during the vibration and aligning operation.

2. The method according to claim 1 and further comprising: inserting tamping tools into the ballast between said pair of contoured shoes; and performing a tamping operation on said ballast.

3. The method according to claim 2 wherein said substantially horizontal track displacement is finished before the completion of said tamping operation.

4. A machine for aligning railroad track into a substantially correct position comprising: laterally and vertically adjustable clamping means adapted to grasp each of the rails of a railroad for purposes of track displacement when aligning track; a pair of contoured shoes, each one of said respective shoes being adapted to embrace a shoulder portion of the railroad ballast located on the outside of each respective rail which is to be aligned; a lifting jack articulately connected to each of said shoes adapted to provide a substantially vertical force to said clamping means; and means to provide vibration to said contoured shoes during an alignment operation, each of said respective contoured shoes having an appropriate surface area whereby in use the force per unit area on said shoe is of a magnitude to substantially prevent said contoured shoe from vertical and lateral movement in said ballast when performing said alignment operation.

5. A track aligning machine according to claim 4 wherein said means to provide vibration comprises a vibration device mounted on each of said contoured shoes.

6. A track aligning machine according to claim 4 wherein said means to provide vibration comprises a pair of mechanical pulsers and said lifting jacks are hydraulically operated, each of said pulsers communicating with the fluid in one of said track lifting jacks.

7. A track aligning machine according to claim 6 wherein each of said pulsers includes a piston rod adapted for reciprocal movement in the respective track lifting jack and communicating with the hydraulic fluid therein.

* * * * *